US008410894B2

(12) United States Patent
Bonaiti

(10) Patent No.: US 8,410,894 B2
(45) Date of Patent: Apr. 2, 2013

(54) METHOD, PARTICULARLY FOR MANUFACTURING TERMINALS FOR ELECTRIC RESISTORS, AND THE TERMINAL OBTAINED

(75) Inventor: Luca Bonaiti, Padova (IT)

(73) Assignee: Bonaiti S.p.A., Mestrino (IT)

( * ) Notice: Subject to any disclaimer, the term of this patent is extended or adjusted under 35 U.S.C. 154(b) by 0 days.

(21) Appl. No.: 13/067,635

(22) Filed: Jun. 16, 2011

(65) Prior Publication Data

US 2011/0309909 A1 Dec. 22, 2011

(30) Foreign Application Priority Data

Jun. 18, 2010 (IT) ..... PD2010A0192

(51) Int. Cl.
*H01C 1/14* (2006.01)

(52) U.S. Cl. ..... 338/322; 338/333; 29/610.1

(58) Field of Classification Search ..... 338/323, 338/329, 333
See application file for complete search history.

(56) References Cited

U.S. PATENT DOCUMENTS

| | | | | |
|---|---|---|---|---|
| 2,597,338 A | | 5/1952 | Kohring | |
| 2,899,666 A | * | 8/1959 | Drugmand et al. | 338/329 |
| 2,999,221 A | * | 9/1961 | Ellis et al. | 439/744 |
| 3,186,209 A | | 6/1965 | Friedman | |
| 3,354,854 A | * | 11/1967 | Kosha | 29/874 |
| 3,399,371 A | * | 8/1968 | Inacker | 439/59 |
| 3,404,370 A | | 10/1968 | Bryner et al. | |
| 4,071,947 A | | 2/1978 | Nippert | |
| 4,416,141 A | | 11/1983 | Nippert | |
| 5,108,316 A | * | 4/1992 | Yamada et al. | 439/660 |
| 2011/0287672 A1 | * | 11/2011 | Fujimoto et al. | 439/801 |

FOREIGN PATENT DOCUMENTS

| | | |
|---|---|---|
| EP | 1 331 696 A2 | 7/2003 |
| EP | 2 178 174 A1 | 4/2010 |
| GB | 832 070 A | 4/1960 |

* cited by examiner

*Primary Examiner* — Kyung Lee
(74) *Attorney, Agent, or Firm* — Modiano & Associati; Albert Josif; Daniel O'Byrne

(57) ABSTRACT

A method for manufacturing terminals for electric resistors consists in preparing a piece of substantially pure copper;

reducing the thickness, by cold pressing, of the piece so as to obtain from it at least one thick part and one thin part designed to form the tip of an electrical terminal to be obtained;

obtaining, by rolling, a groove which is central to the thick part; and tapering, by rolling, the thin portion.

8 Claims, 2 Drawing Sheets

METHOD, PARTICULARLY FOR MANUFACTURING TERMINALS FOR ELECTRIC RESISTORS, AND THE TERMINAL OBTAINED

The present invention relates to a method, particularly for manufacturing terminals for electric resistors, and to the terminal produced.

BACKGROUND OF THE INVENTION

Nowadays, terminals for electric resistors are produced by performing turning operations on pieces of wire or a rod of copper alloy.

Indeed because of the poor workability of pure copper, and in particular because of the propensity to being used as a material to be turned, it is generally alloyed with tellurium or other materials.

Such alloy of copper and tellurium thus makes it possible to impose a cutting speed that results in profitable productivity, furthermore making it possible to achieve a satisfactory finish of the worked pieces.

However, the technique used today for producing terminals for electric resistors, which consists in turning pieces made from copper and tellurium alloy, exhibits some drawbacks, including the poor economy of the working material, which can be ascribed to the losses of swarf owing to the choice of turning as a technique for forming the terminals.

Furthermore, nowadays copper and tellurium alloy is relatively valuable and hence it costs more, for example, than pure copper.

These drawbacks naturally engender a vicious circle that spurs makers of terminals for electric resistors to find solutions that make it possible to use materials that are less valuable but which have satisfactory performance and/or processes for working these materials which make it possible to achieve a higher level of productivity and a high level of quality of the products, with better economy of materials.

SUMMARY OF THE INVENTION

The aim of the present invention is to provide a method, particularly for the production of terminals for electric resistors, which meets such need, by making it possible to produce terminals from material that is less valuable and with better economy than conventional methods of production.

Within this aim, an object of the invention is to provide a method that makes it possible to use substantially pure copper while ensuring a productivity and finish of the products that compete with the productivity and finish of the products that can be obtained using conventional methods.

Another object of the invention is to provide a method that results in lower quantities of swarf material than conventional methods.

Another object of the invention is to provide a method that is simple and easily implemented, and which can be implemented at low cost.

Another object of the invention is to provide a terminal, particularly for electric resistors, which is made of a material that is less valuable than the terminals that can be obtained today using conventional methods.

Another object of the invention is to provide a terminal that is easy to solder to electric resistors with which it is designed to be joined.

This aim and these objects, as well as others which will become better apparent hereinafter, are achieved by a method, particularly for the production of terminals for electric resistors, characterized in that it consists in preparing a piece of substantially pure copper, reducing the thickness, by cold pressing, of said piece so as to obtain from it at least one thick part and one thin part designed to form the tip of an electrical terminal to be obtained, obtaining, by rolling, a groove which is central to said thick part, tapering, by rolling, said thin portion.

This aim and these objects, as well as others which will become better apparent hereinafter, are achieved by a terminal for electric resistors, which comprises a thin portion that has a tip that is adapted to be joined to an electric resistor, and a consecutive thick part, in a central region of which a groove is provided, which has the peculiarity of being made of substantially pure copper.

BRIEF DESCRIPTION OF THE DRAWINGS

Further characteristics and advantages of the invention will become better apparent from the detailed description of a preferred, but not exclusive, embodiment of the method and of the terminal, according to the invention, which are illustrated for the purposes of non-limiting example in the accompanying drawings wherein.

DESCRIPTION OF THE PREFERRED EMBODIMENTS

Figure 1:
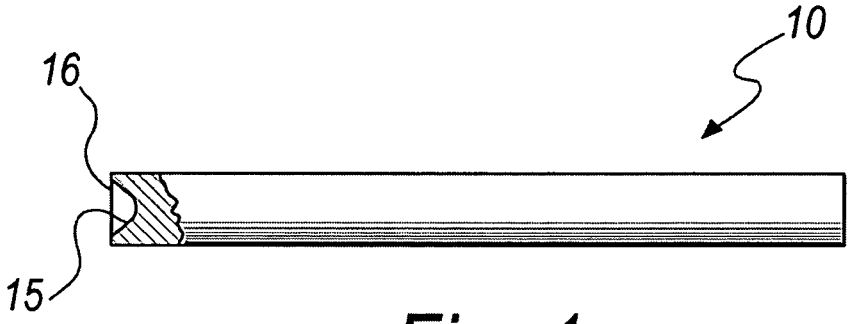
FIGS. 1, 2, 3, 4 and 5 are partially sectional side elevation views of semi-processed pieces obtained from operations of a method according to the invention.

With reference to the figures, a method, particularly for the production of terminals for electric resistors, according to the invention has a peculiarity in that it consists in preparing a piece 10 of substantially pure copper, reducing the thickness, by conveniently longitudinal cold pressing, of the piece 10 so as to obtain from it a thick part 11 and a thin part 12 which are consecutive, the thin part 12 being designed to form the tip of an electrical terminal to be obtained, the operation of reducing the thickness being preferably performed by means of longitudinal cold pressing of a portion of the piece 10 which comprises one of its ends 10*a*, advantageously, forming, by conveniently front cold pressing, a head 13 that can be used for handling the piece and is formed on the thin portion 12, obtaining, by rolling, a groove 14, in a substantially central position of the thick part 11, tapering, by rolling, the thin portion 12, conveniently also removing the head 13 therefrom.

Furthermore, according to the contingent requirements of implementation of the invention, the operation of reducing the thickness involves the formation of at least one thick part.

For example, this can involve the formation of a first thick part and of a second thick part of smaller diameter and consecutive to the first thick part and interposed between the first thick part and the thin part, the formation of the groove being provided on the second thick part.

The tapering operation conveniently involves the conical rolling of the thin portion 12, until the head 13 is truncated by progressive thinning.

Figure 2:
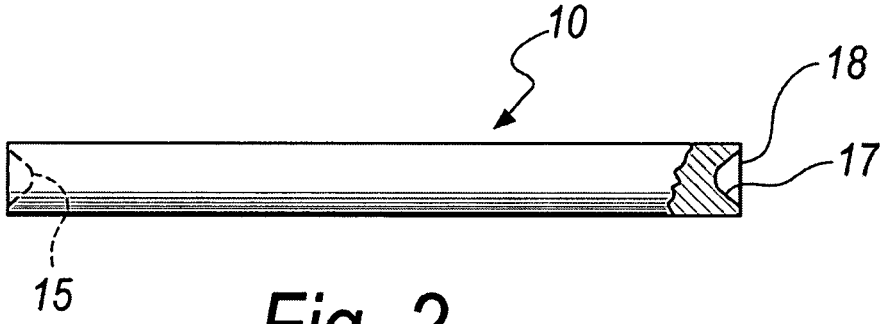

More specifically, advantageously, the operation of preparing the piece 10 comprises, with particular reference to FIGS. 1 and 2, cropping to size the piece 10, from a copper rod, defining a first centering seat 15 on a first end face 16 of the piece 10, defining a second centering seat 17 on the second end face 18 of the piece 10.

Furthermore, a terminal 19 for electric resistors, comprising a thin part 12 which has a tip 20 adapted to be joined to an electric resistor, and a consecutive thick part 11, in a central region of which a groove 14 is provided, has a peculiarity in that it is made of substantially pure copper and, in particular, advantageously of pure copper.

Preferably, the tip 20 has a rough surface, as advantageously obtained as a result of a formation by rolling.

In this way the implementation of a method according to the invention consists conveniently in the sequence of these operations, advantageously actuated in the sequence that follows.

Initially, conveniently the operation of preparing the piece 10 is performed, by cutting from a rod of copper and defining the first centering seat 15 and subsequently the second centering seat 17, provided as dead holes.

Figure 3:
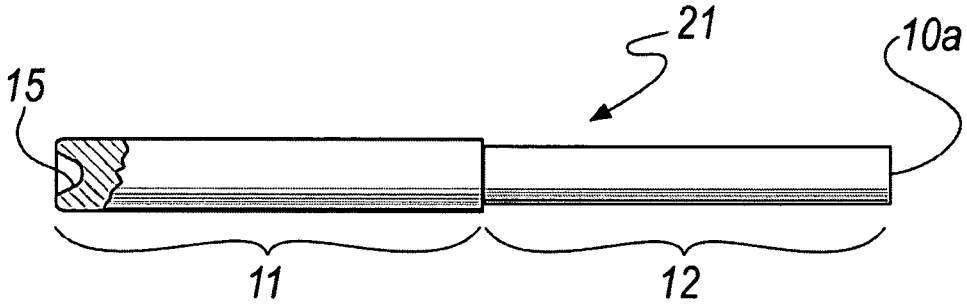
Figure 4:
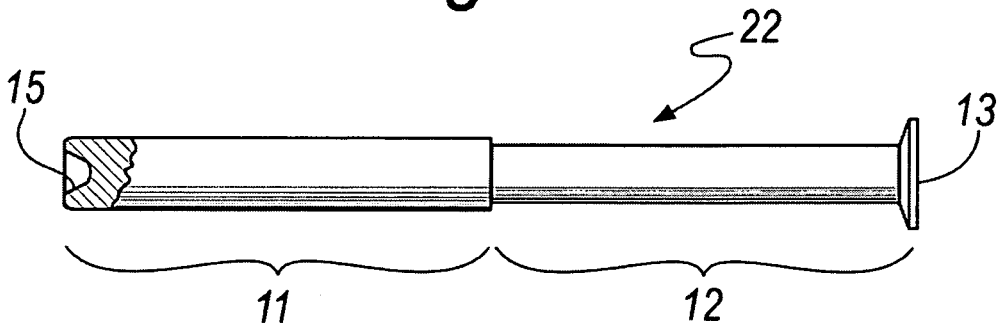
Figure 5:
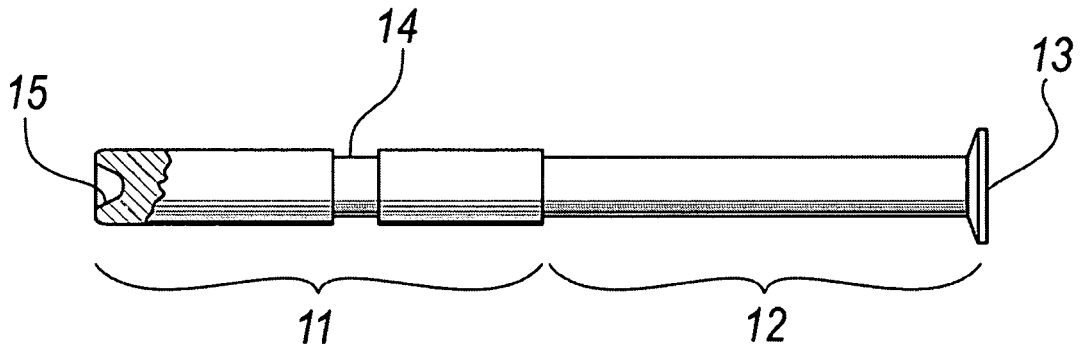
Figure 6:
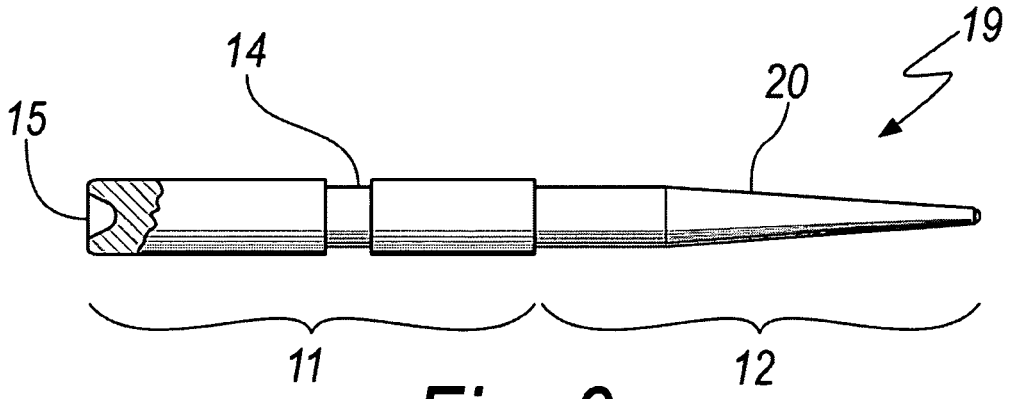
FIG. 6 is a partially sectional side elevation view of a terminal, according to the invention.

Then the piece 10, thus prepared for subsequent working, is moved to the station for actuating the operation of reducing the thickness of the piece 10, conveniently by means of longitudinal cold pressing, so as to obtain a first semi-processed piece 21 that has the thick 11 and thin 12 parts consecutive, such as for example as shown for the purposes of non-limiting example in FIG. 3.

Subsequently, the operation of forming the head 13 is performed, by means of front pressing of the end 10*a*.

In this way, the head 13 is formed as a thin flange so as to enable an easy and oriented grip of the second semi-processed piece 22 thus obtained, for its subsequent arrangement in the following work stations.

Advantageously, two rolling operations then follow, of which a first actuates the operation to obtain the groove 14, and a second actuates the operation of tapering the thin portion 12 so as to obtain the tip 20, with simultaneous detachment of the head 13.

In this way, the tip 20 obtained by rolling, which is designed to be connected, for example by soldering, to an electric resistor, has a rough surface which is to the advantage of its easy and effective joining to the resistor.

In practice it has been found that the invention fully achieves the intended aim and objects by providing a method, particularly for the production of terminals for electric resistors, that enables the production of terminals in a material that is less valuable and with better economy than methods of production known today.

A method according to the invention makes it possible to use substantially pure copper while ensuring a productivity and finish of the products that compete with the productivity and finish of the products that can be obtained using conventional methods.

"Substantially pure copper", as defined herein is a high conductivity copper, particularly an E.T.P. copper. A copper that has been used with good results is the copper CU-ETP1 UNI EN 1977, that has a copper content of 99.9%, which amounts a practically pure copper.

And also, a method according to the invention involves smaller quantities of swarf material compared to conventional methods, and indeed, compared to these, what is discarded is only the material that constitutes the head, which is truncated by rolling, and which is very much less than the swarf material discarded in the form of shavings in conventional procedures.

And also, a method according to the invention is simple and easily implemented, and can be implemented at low cost.

A terminal according to the invention furthermore enables an easy and effective join with electric resistors with which it is designed to be joined, due to the finish of its tip obtained by rolling.

The invention, thus conceived, is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

The disclosures in Italian Patent Application No. PD2010A000192 from which this application claims priority are incorporated herein by reference.

What is claimed is:

1. A method for manufacturing terminals for electric resistors, comprising preparing a piece of substantially pure copper, reducing the thickness, by cold pressing, of said piece so as to obtain from said niece at least one thick part and one thin part designed to form the tip of an electrical terminal to be obtained, obtaining, by rolling, a groove which is central to said thick part, forming, by cold pressing, a handling head on said thin part, tapering, by rolling, said thin part and including removing said handling head from said thin part.

2. The method of claim 1, comprising forming said handling head as a flange at an end of said thin part.

3. The method of claim 1 wherein said tapering operation provides for the longitudinal cold pressing of a portion of said piece which comprises one of its ends.

4. The method of claim 2, wherein said forming of the head provides for the front cold pressing of said one end.

5. The method of claim 1, wherein said tapering operation provides for a conical rolling of said thin part, in order to crop said head by thickness reduction.

6. The method of claim 1, wherein said operation of preparing said piece comprises cropping to size said piece from a copper rod, forming a first centering seat on a first end face of said piece, forming a second centering seat on the second end face of said piece.

7. The method of claim 1, comprising tapering said thin part into a tip having a rough surface.

8. The method of claim 6, comprising providing said first and second centering seats as dead holes.

* * * * *